US008302427B2

(12) United States Patent
Kamimura

(10) Patent No.: US 8,302,427 B2
(45) Date of Patent: Nov. 6, 2012

(54) EVAPORATOR

(75) Inventor: Satoshi Kamimura, Saitama (JP)

(73) Assignee: Calsonic Kansei Corporation, Saitama (JP)

( * ) Notice: Subject to any disclaimer, the term of this patent is extended or adjusted under 35 U.S.C. 154(b) by 404 days.

(21) Appl. No.: 12/451,045

(22) PCT Filed: Apr. 18, 2008

(86) PCT No.: PCT/JP2008/057598

§ 371 (c)(1),
(2), (4) Date: Oct. 23, 2009

(87) PCT Pub. No.: WO2008/133203

PCT Pub. Date: Nov. 6, 2008

(65) Prior Publication Data

US 2010/0115987 A1 May 13, 2010

(30) Foreign Application Priority Data

Apr. 25, 2007 (JP) ..... 2007-115257

(51) Int. Cl.
*F25B 39/02* (2006.01)

(52) U.S. Cl. ..... 62/519; 62/524; 62/515

(58) Field of Classification Search ..... 62/515, 62/519, 524

See application file for complete search history.

(56) References Cited

U.S. PATENT DOCUMENTS

| | | | |
|---|---|---|---|
| 5,678,419 A | 10/1997 | Sanada et al. | |
| 2005/0050915 A1 | 3/2005 | Inaba et al. | |
| 2005/0223739 A1 | 10/2005 | Inaba | |
| 2006/0191673 A1 | 8/2006 | Inaba | |
| 2006/0207757 A1 * | 9/2006 | Danielsson et al. | 165/159 |

FOREIGN PATENT DOCUMENTS

| | | |
|---|---|---|
| EP | 1 515 104 | 3/2005 |
| EP | 1 582 834 | 10/2005 |
| EP | 1 703 232 | 9/2006 |
| JP | 8-75310 | 3/1996 |
| JP | 2002-323296 | 11/2002 |
| JP | 2005-83677 | 3/2005 |
| JP | 2005-315567 | 11/2005 |
| JP | 2006-242406 | 9/2006 |

OTHER PUBLICATIONS

International Search Report issued Jun. 17, 2008 in International (PCT) Application No. PCT/JP2008/057598.

* cited by examiner

*Primary Examiner* — Cheryl J Tyler
*Assistant Examiner* — Jonathan Koagel
(74) *Attorney, Agent, or Firm* — Wenderoth, Lind & Ponack, L.L.P.

(57) ABSTRACT

An evaporator includes two heat exchangers including an entry-side heat exchanger and an exit-side heat exchanger which are arranged opposite each other. The entry-side heat exchanger has a first path, a second path, and a third path, and the exit-side heat exchanger has a fourth path, a fifth path, and a sixth path. The sectional area of heat exchange passages of the first path in which refrigerant from an entry firstly flows downward is set smaller than the sectional area of heat exchange passages of the fifth path in which the refrigerant lastly flows downward. The sectional area of heat exchange passages of the sixth path in which the refrigerant to an exit lastly flows upward is set smaller than the sectional area of heat exchange passages of the second path in which the refrigerant firstly flows upward.

2 Claims, 7 Drawing Sheets

EVAPORATOR

TECHNICAL FIELD

The present invention relates to an evaporator which is applied as an evaporator or the like provided in a refrigeration cycle of an automotive air conditioner, and which has in the airflow direction two heat exchangers, namely, an entry-side heat exchanger and an exit-side heat exchanger disposed opposite each other.

BACKGROUND ART

A conventionally known evaporator has in the airflow direction two heat exchangers, namely, an entry-side heat exchanger (=leeward side heat exchanger) and an exit-side heat exchanger (=windward side heat exchanger) placed opposite each other, each of which has an upper tank, a lower tank, and a plurality of heat exchange passages connected between both of the tanks, a plurality of heat exchange passages being sectioned into a plurality of paths (heat exchange passage groups). In addition, a plurality of paths includes, according to a passing order of refrigerant, in the entry-side heat exchanger a first path, a second path and a third path and in the exit-side heat exchanger a fourth path, a fifth path and a sixth path.

Such an evaporator is preferable because cooling of air can be compensated for by the two heat exchangers, so that unevenness of temperature distribution can be reduced compared to that in an evaporator having one heat exchanger. However, when the sectional area of heat exchange passages of each path is equal, a region which can cool down venting wind and a region which can not significantly cool down venting wind are generated, causing unevenness of temperature distribution.

On the other hand, in order to reduce the unevenness of temperature distribution, an evaporator in which the number of heat exchange passages in the path where the refrigerant flows upward is set smaller than the number of heat exchange passages in the path where the refrigerant flows downward is proposed (for example, JP2005-83677A).

In order to further reduce the unevenness of temperature distribution, an evaporator is also proposed in which the number of heat exchange passages in the first path is set to be smaller than the number of heat exchange passages in any other paths in the entry-side heat exchanger, and the number of heat exchange passages is gradually increased from the fourth path to the last path (sixth path) in the exit-side heat exchanger (for example, JP2006-242406A).

The conventional evaporator described in JP2005-83677A, however, has the following problem. The number of heat exchange passages in the first path where the refrigerant flows downward is increased, so that when the refrigerant flow volume is small, a region where the refrigerant flow volume is reduced is generated in the back side of the longitudinal direction of the tank of the first path in the entry-side heat exchanger (=leeward side heat exchanger), and a high temperature portion is locally generated in the region where the refrigerant flow volume is reduced.

The conventional evaporator described in JP2006-242406A also has the following problem. The number of heat exchanging passages in the sixth path where the refrigerant flows upward is increased, so that a region where the refrigerant flow volume is reduced is generated in the front side of the longitudinal direction of the tank of the sixth path in the exit-side heat exchanger (=windward side heat exchanger), and a high temperature region is locally generated in the region where the refrigerant flow volume is reduced. Summary of the Invention The present invention has been made in view of the above problems. An object of the present invention is to provide an evaporator which can equalize temperature distribution in a heat exchanger by minimizing a region having a reduced refrigerant flow volume which causes unevenness of temperature distribution.

MEANS FOR SOLVING THE PROBLEMS

In order to achieve the above object, an evaporator according to one embodiment of the present invention comprises a heat exchanger including a plurality of heat exchange passages, each of which extends in an up-and-down direction and is laminated in a right-and-left direction, and a tank which is connected to both ends of the heat exchange passages and mixes and distributes refrigerant from the heat exchange passages. The heat exchanger has a two-layer structure having an entry-side heat exchanger on a leeward side and an exit-side heat exchanger on a windward side relative to a ventilating direction, an entry and an exit for the refrigerant are provided in one of the right-and-left direction of the heat exchangers. A communication portion, which connects the heat exchangers so as to communicate with each other, is provided in the other of the right-and-left direction of the heat exchangers. After flowing the refrigerant in the entry-side heat exchanger from the entry, the refrigerant is led to the exit via the exit-side heat exchanger. The entry-side heat exchanger includes a first path in which the refrigerant flows downward, a second path in which the refrigerant flows upward, and a third path in which the refrigerant flows downward, and the exit-side heat exchanger includes a fourth path in which the refrigerant flows upward, a fifth path in which the refrigerant flows downward, and a sixth path in which the refrigerant flows upward. A sectional area of the heat exchange passages of the first path in which the refrigerant from the entry firstly flows downward is set smaller than a sectional area of the heat exchange passages of the fifth path in which the refrigerant to the exit finally flows downward, and a sectional area of the heat exchange passages of the sixth path in which the refrigerant to the exit finally flows upward is set smaller than a sectional area of the heat exchange passages of the second path in which the refrigerant from the entry firstly flows upward.

DETAILED DESCRIPTION OF THE PRESENT INVENTION

The best mode for realizing an evaporator of the present invention will be hereinafter described according to Embodiment 1 illustrated in drawings.

Embodiment 1

Figure 1:
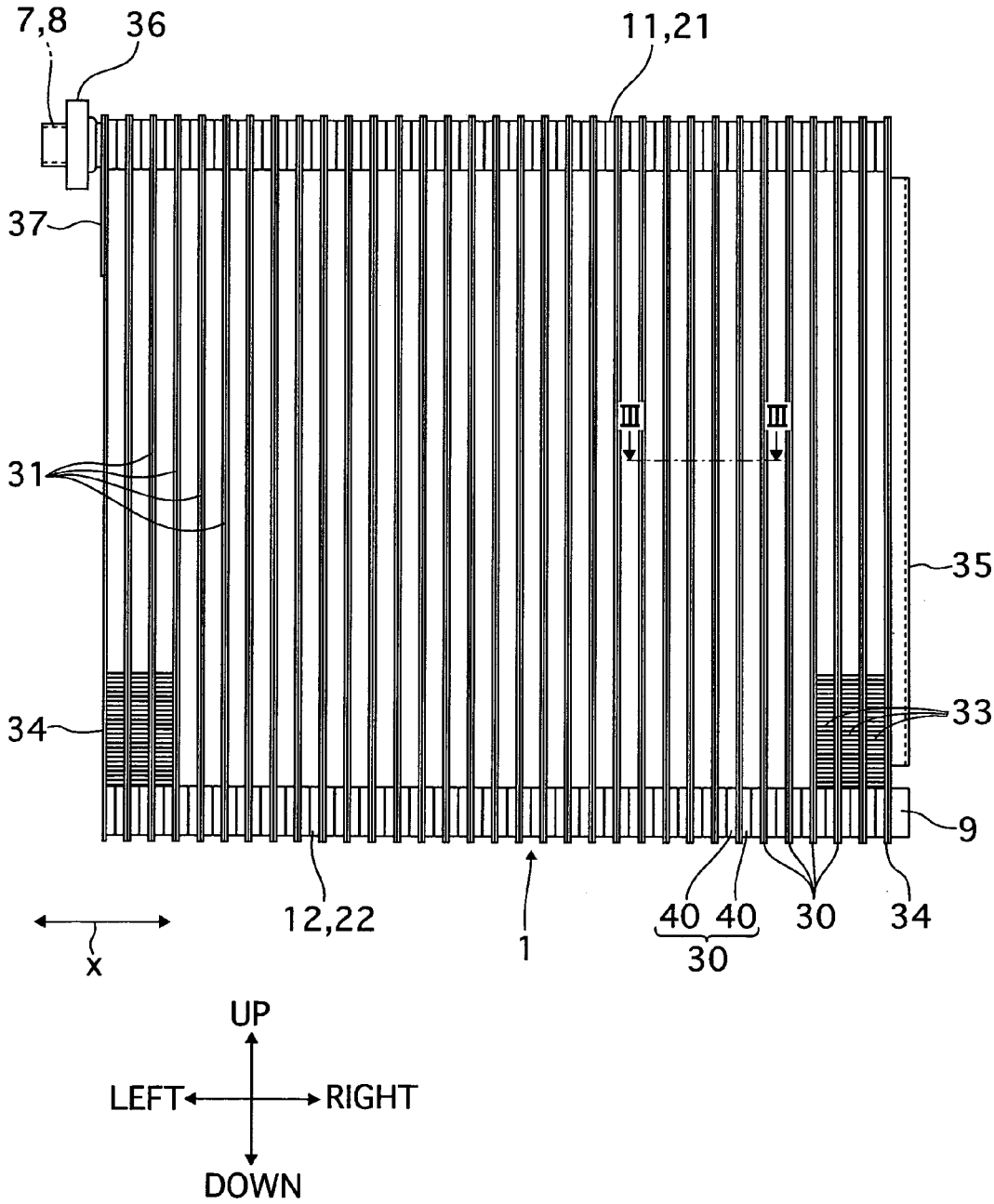
FIG. 1 is a plan view illustrating an entire evaporator in Embodiment 1 as seen from the windward side.
Figure 2:
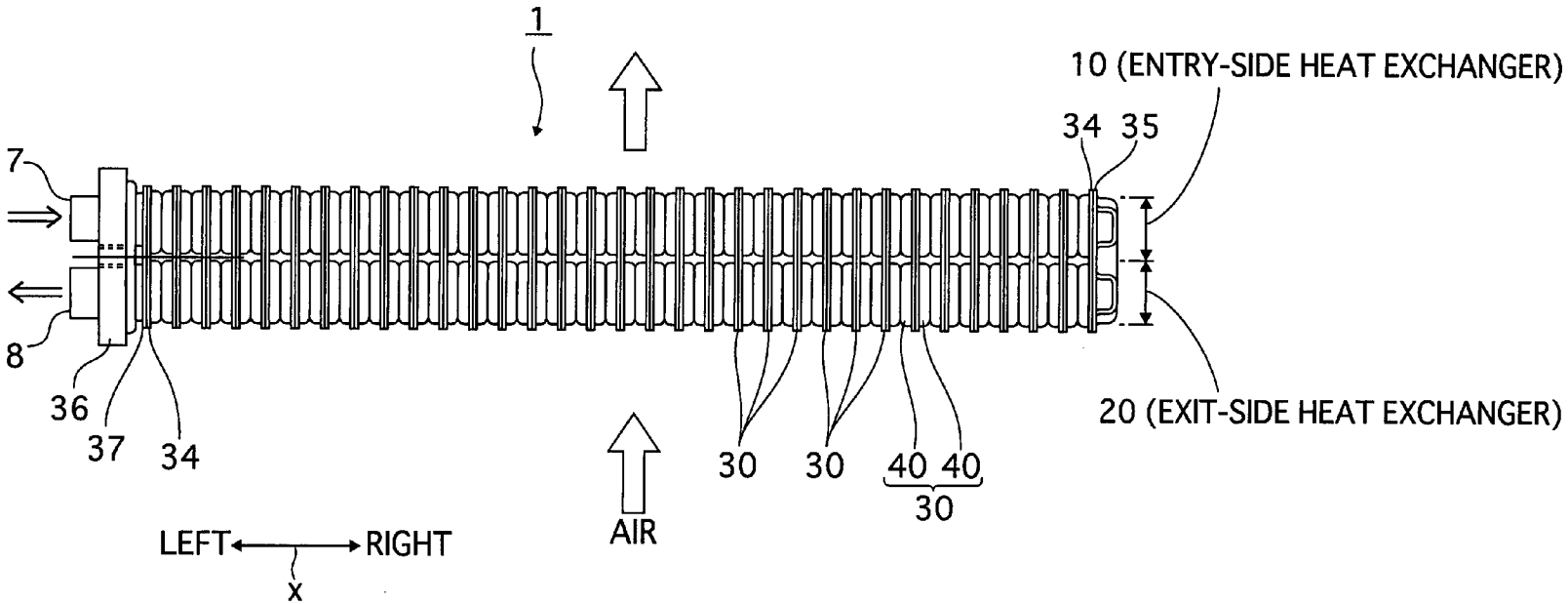
FIG. 2 is a plan view illustrating the entire evaporator in Embodiment 1 as seen from the upper side.
Figure 3:
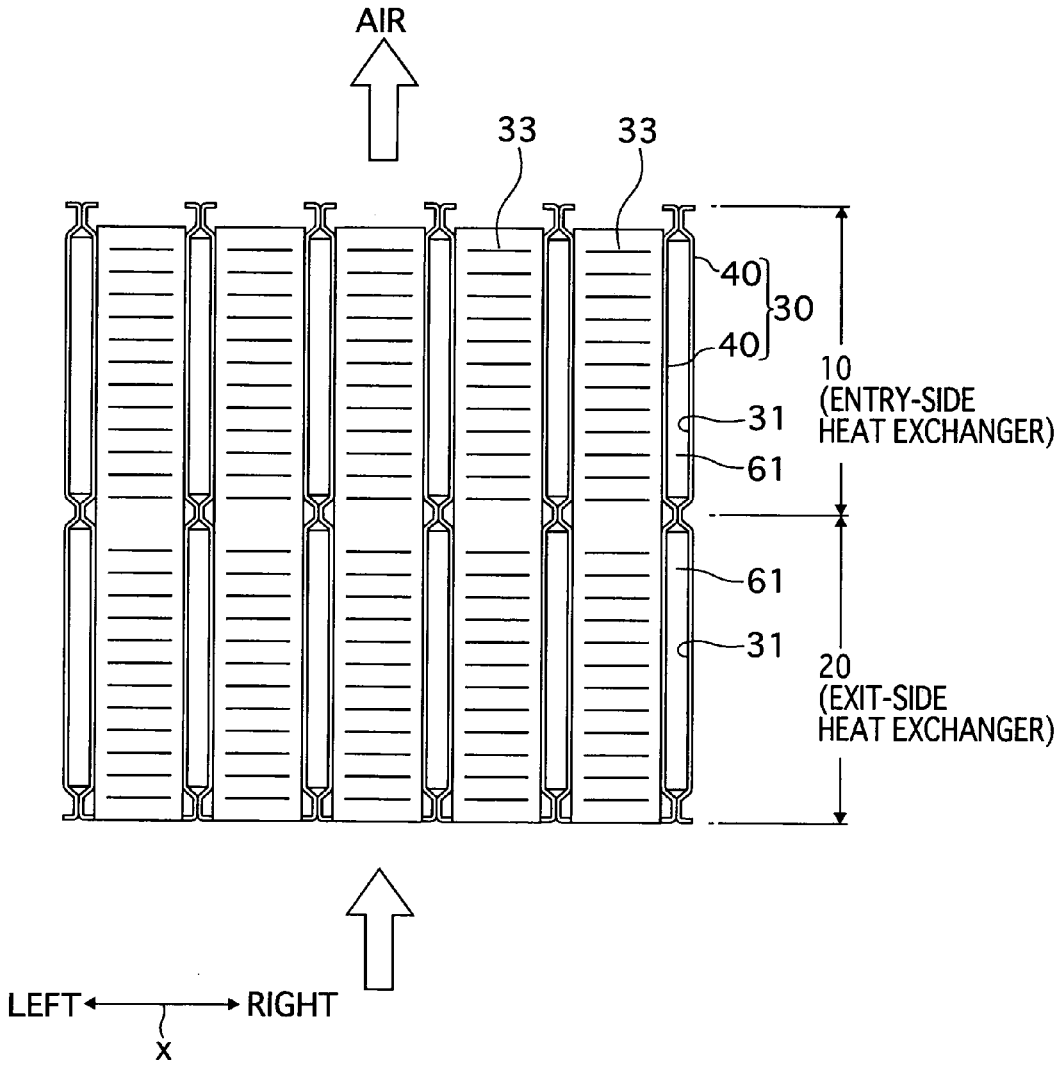
FIG. 3 is a sectional view along the III-III line in FIG. 1 illustrating an inner structure of the evaporator in Embodiment 1.
Figure 4A:
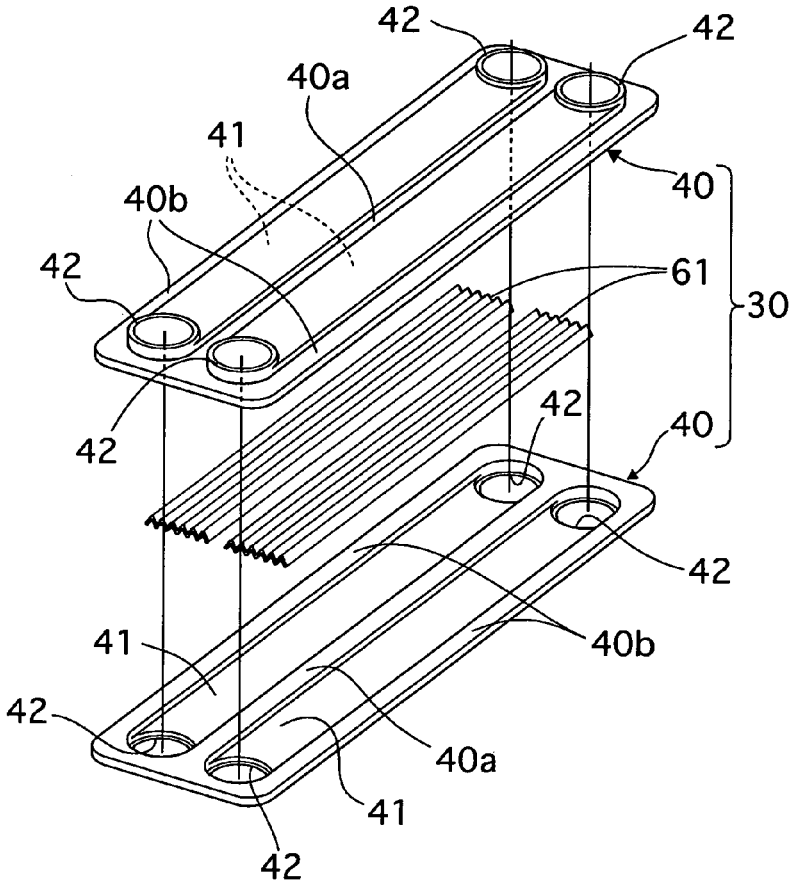
FIG. 4A is an exploded perspective view illustrating a tube structure of the evaporator in Embodiment 1.
Figure 4B:
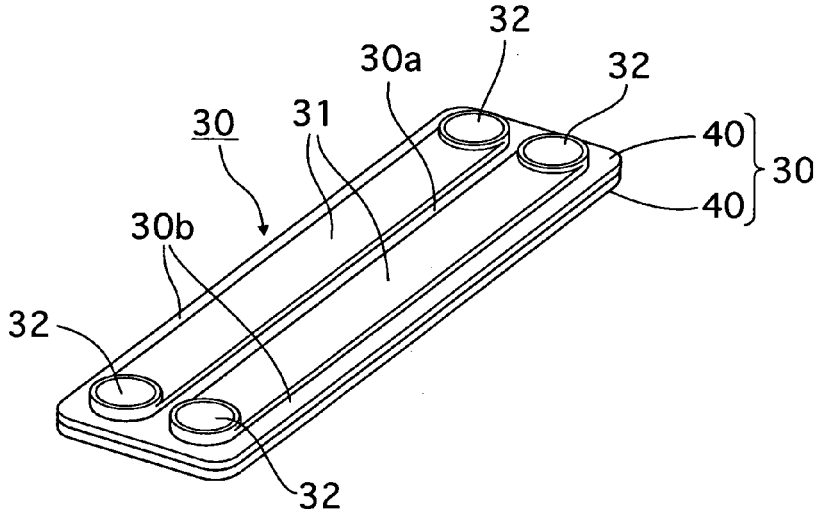
FIG. 4B is a perspective view illustrating the tube of the evaporator in Embodiment 1.
Figure 5:
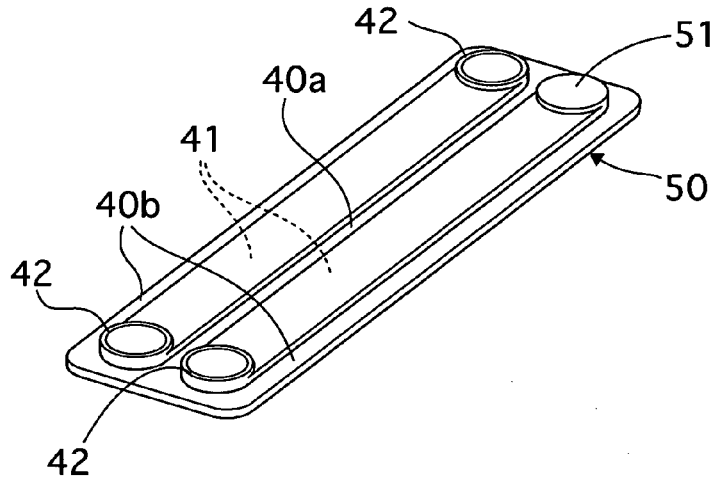
FIG. 5 is a perspective view illustrating a metal thin plate having a partition of a tank of the evaporator in Embodiment 1.

At first, the structure will be described. FIG. 1 is a plan view illustrating an entire evaporator in Embodiment 1 as seen from the windward side. FIG. 2 is a plan view illustrating the entire evaporator in Embodiment 1 as seen from the upper side. FIG. 3 is a sectional view along the III-III line in FIG. 1 illustrating an inner structure of the evaporator in Embodiment 1. FIG. 4A is an exploded perspective view illustrating a tube structure of the evaporator in Embodiment 1. FIG. 4B is a perspective view illustrating the tube of the evaporator in Embodiment 1. FIG. 5 is a perspective view illustrating a metal thin plate having a partition of a tank of the evaporator in Embodiment 1.

An evaporator 1 of Embodiment 1 is an evaporator which is provided in a refrigeration cycle of an automotive air conditioner, and disposed in an air conditioning case inside an instrument panel so as to cool down air by heat exchange between refrigerant flowing through the inside and air passing by the outside and evaporating the refrigerant.

The evaporator 1 of Embodiment 1 includes a plurality of tubes 30 arranged in the vertical direction. The plurality of tubes 30 is laminated in the horizontal direction with outer fins 33 therebetween. The evaporator 1 is manufactured by integrally brazing the plurality of tubes 30 in a state in which side plates 35, 37 for reinforcement and a piping connector 36 and the like are disposed at the outermost side of the tube lamination direction (the outermost side of the horizontal direction) in a predetermined shape (refer to FIGS. 1, 2, 3, 4A, 4B). In addition, reference number 34 in FIGS. 1, 2 is a metal thin plate for the outermost end.

Figure 6:
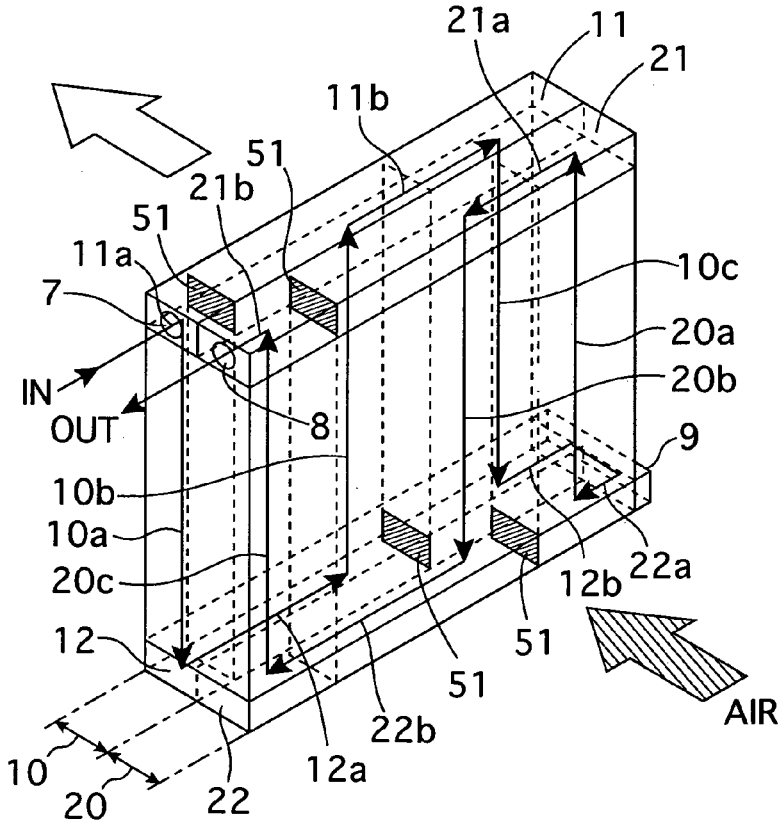
FIG. 6 is a schematic perspective view illustrating a heat exchanger of the evaporator in Embodiment 1.
Figure 7:
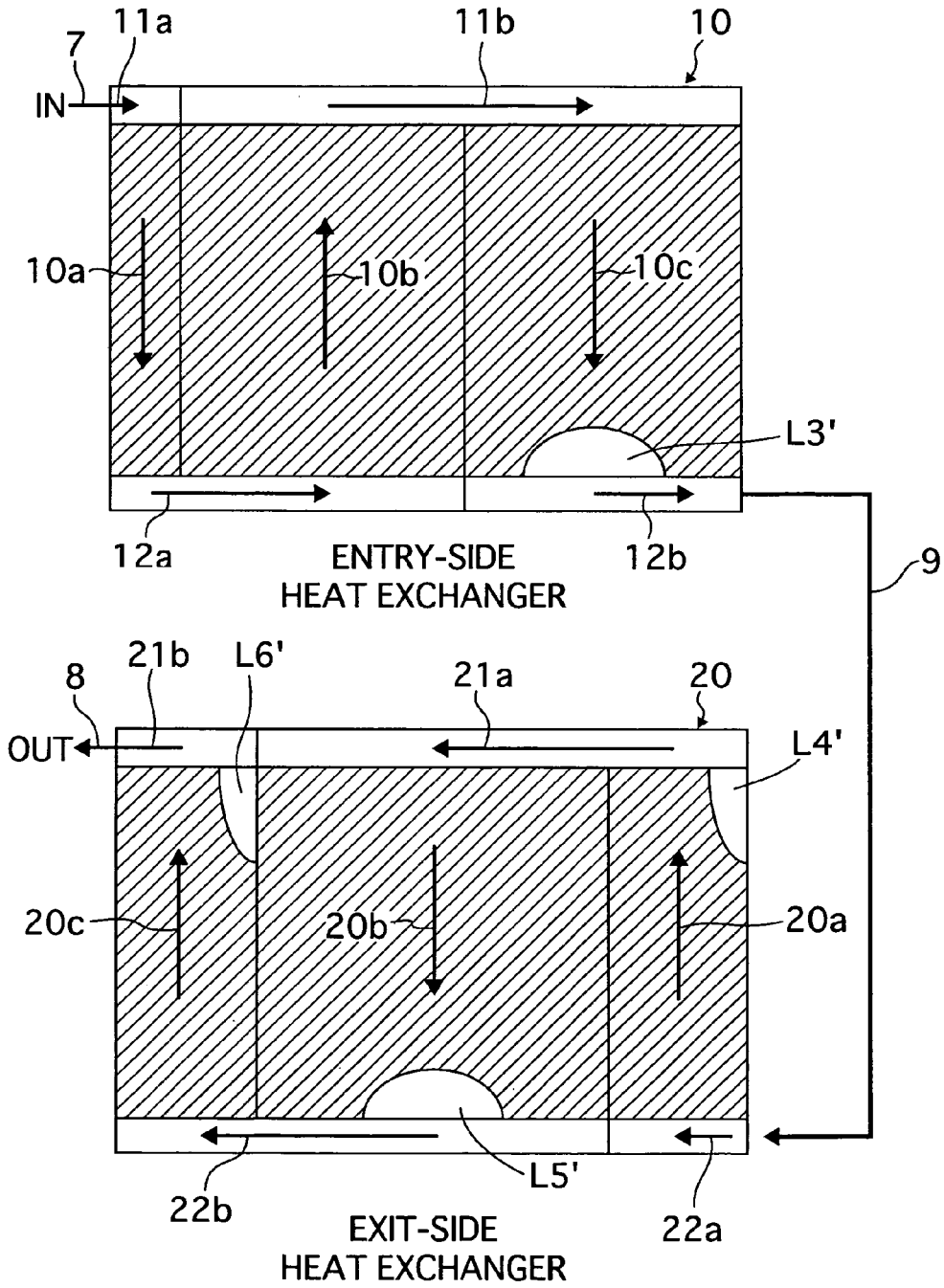
FIG. 7 is a schematic view illustrating the section setting in each path of an entry-side heat exchanger and each path of an exit-side heat exchanger in the evaporator in Embodiment 1.

As illustrated in FIG. 4A, the tube 30 to be used is formed by a pair of metal thin plates 40, 40 having inner fins 61, 61 therebetween. A pair of metal thin plates 40, 40 is jointed by peripheral joining portions 40*b* and central dividing portions 40*a*. As illustrated in FIG. 4B, the tube 30 includes inside thereof two heat exchange passages 31, 31, in which refrigerant flows, across the central dividing portion 30*a*. Each heat exchange passage 31 has in both end portions tank portions 32, 32, respectively, each of which projects outwardly in the lamination direction X. Accordingly, each metal thin plate 40 which forms the tube 30 includes a structure having two concave portions 41 for the heat exchange path and four tanks 42. In addition, by using a metal thin plate 50 having a partition 51 illustrated in FIG. 5 instead of the metal thin plate 40 in a predetermined lamination position, each of tanks 11, 12, 21, 22 is separated FIG. 6 is a schematic perspective view illustrating a heat exchanger of the evaporator in Embodiment 1. FIG. 7 is a schematic view illustrating section setting in each path of an entry-side heat exchanger and each path of an exit-side heat exchanger in the evaporator in Embodiment 1.

The evaporator 1 of Embodiment 1 includes on the leeward side an entry-side heat exchanger 10 for refrigerant, and on the windward side an exit-side heat exchanger 20 for refrigerant, which are arranged in parallel.

The entry-side heat exchanger 10 includes a plurality of tubes 30 (refer to FIGS. 1, 3) comprising a plurality of heat exchange passages 31 connected between an upper tank 11 and a lower tank 12. The exit-side heat exchanger 20 also includes a plurality of tubes 30 (refer to FIGS. 1, 3) comprising a plurality of heat exchange passages 31 connected between an upper tank 21 and a lower tank 22.

The entry-side heat exchanger 10 includes the heat exchange passage groups sectioned into a first path 10*a*, a second path 10*b* and a third path 10*c* from left to right. In particular, an entry (inlet port) 7 of the evaporator is provided at the left end of the upper tank 11, and the upper tank 11 is divided into a first upper tank 11*a* and a second upper tank 11*b* by the partition 51. The lower tank 12 is also divided into a first lower tank 12*a* and a second lower tank 12*b* by the partition 51. The heat exchange passage groups are thereby sectioned into the first path 10*a*, the second path 10*b* and the third path 10*c* from left to right.

Accordingly, if the refrigerant is introduced into the entry-side heat exchanger 10 from the entry 7 of the evaporator, the refrigerant flows in the following order, the first upper tank 11*a*, the first path 10*a*, the first lower tank 12*a*, the second path 10*b*, the second upper tank 11*b*, the third path 10*c*, and the second lower tank 12*b*. The refrigerant is finally introduced into the most upstream portion (first lower tank 22*a*) of the exit-side heat exchanger 20 via a communication portion 9.

The exit-side heat exchanger 20 also includes heat exchange passage groups sectioned into a fourth path 20*a*, a fifth path 20*b* and a sixth path 20*c* from right to left. In particular, the lower tank 22 is divided into a first lower tank 22*a* and a second lower tank 22*b* by the partition 51. The upper tank 21 is also divided into a first upper tank 21*a* and a second upper tank 22*b* by the partition 51. An exit (outlet port) 8 of the evaporator is provided at the left end of the upper tank 21. The heat exchange passage groups are thereby sectioned into the fourth path 20*a*, the fifth path 20*b* and the sixth path 20*c* from the right to left.

Accordingly, the refrigerant introduced into the exit-side heat exchanger 20 from the communication portion 9 flows in the following order; the first lower tank 22*a*, the fourth path 20*a*, the first upper tank 21*a*, the fifth path 20*b*, the second lower tank 22*b*, the sixth path 20*c*, and the second upper tank 21*b*. The refrigerant is finally discharged from the evaporator 1 via the exit (outlet port) 8 of the evaporator.

Next, the sectioning of the path in the evaporator 1 of Embodiment 1 will be described with reference to FIGS. 6, 7.

The evaporator 1 of Embodiment 1 includes three paths in the entry-side heat exchanger 10 and three paths in the exit-side heat exchanger 20. In the entry-side heat exchanger 10, the first path 10*a* is a downward flow path, the second path 10*b* is an upward flow path, and the third path 10*c* is a downward flow path. In the exit-side heat exchanger 20, the fourth path 20*a* is an upward flow path, the fifth path 20*b* is a downward flow path, and the sixth path 20*c* is an upward flow path.

In the evaporator 1 of Embodiment 1, the sectional area of the heat exchange passage of the first path 10*a* in which the refrigerant from the entry 7 firstly flows downward is set smaller than the sectional area of the heat exchange passage of the fifth path 20*b* in which the refrigerant to the exit 8 finally flows downward. The sectional area of the heat exchange passage of the sixth path 20*c* in which the refrigerant to the exit 8 finally flows upward is set smaller than the sectional area of the heat exchange passage of the second path 10*b* in which the refrigerant from the entry 7 firstly flows upward.

More particularly, where the sectional area of each heat exchange passage (=sectional area of tube) in the first path 10*a*, the second path 10*b*, the third path 10*c*, the fourth path 20*a*, the fifth path 20*b*, and the sixth path 20*c* is the same, the following relationships (a) to (d) are established as the relationships of the number of heat exchange passages in the first path 10*a* to the sixth path 20*c*.

(a) The number of passages in the first path<the number of passages in the second path to the number of passages in the sixth path (b) The number of passages in the second path≧the number of passages in the third path (c) The number of passages in the third path>the number of passages in the fourth path (d) The number of passages in the fifth path>the number of passages in the sixth path≧the number of passages in the fourth path Next, the function will be described. In the evaporator, the ultimate problem to be solved is to obtain high heat exchange efficiency while eliminating unevenness of temperature distribution. In order to solve this problem, an evaporator, which includes a double-layered heat exchanger having the entry-side heat exchanger on the leeward side and the exit-side heat exchanger on the windward side, divides (sections) each heat exchange passage into a plurality of paths (heat exchange passage groups), compensates cooling of air by the two heat exchangers, and reduces unevenness of temperature distribution compared with an evaporator having one heat exchanger. However, when the sectional area of the heat exchange passage of each path is equal, a region which can cool down venting wind and a region which can not significantly cool down venting wind are formed, which apparently causes unevenness of temperature distribution.

Figure 8A:
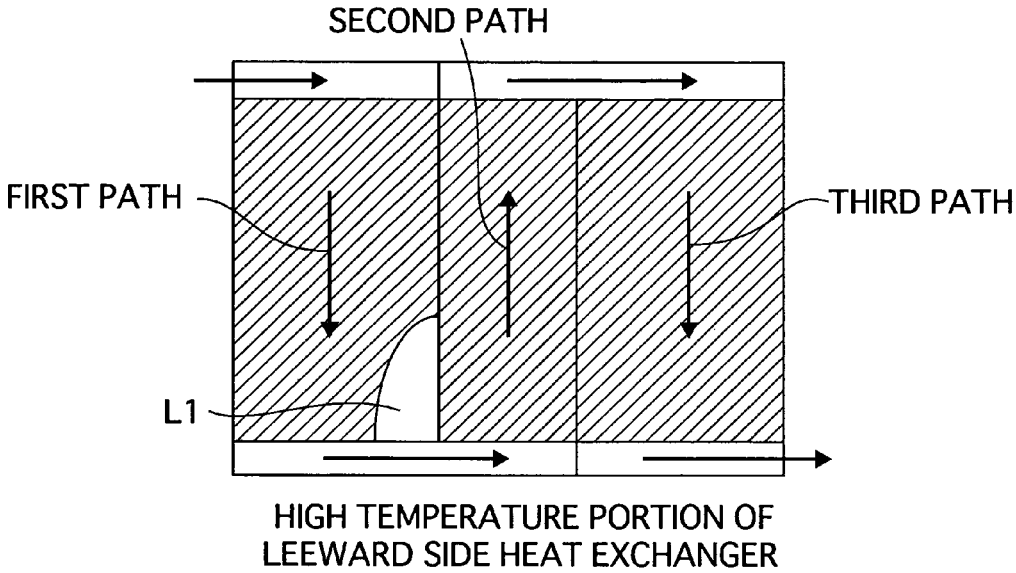
FIG. 8A is a schematic view illustrating the section setting of each path in an entry-side heat exchanger in the conventional evaporator.

In contrast, in JP2005-83677A, an evaporator in which the number of heat exchange passages in the path where the refrigerant flows upward is set smaller than that in the path in which the refrigerant flows downward is proposed, in order to further reduce the unevenness of temperature distribution. However, in the entry-side heat exchanger of the leeward side having two paths in which the refrigerant flows downward and one path in which the refrigerant flows upward, as illustrated in FIG. 8A, the number of heat exchange passages in the first path and the third path in which the refrigerant flows downward is finally increased by reducing the number of heat exchange passages in the second path in which the refrigerant flows upward. For this reason, in the entry-side heat exchanger of the leeward side, a region L1 in which the refrigerant flow volume is reduced is generated in the back side of the longitudinal direction of the tank of the first path, and a high temperature portion is locally generated in the region L1 in which the refrigerant flow volume is reduced.

Figure 8B:
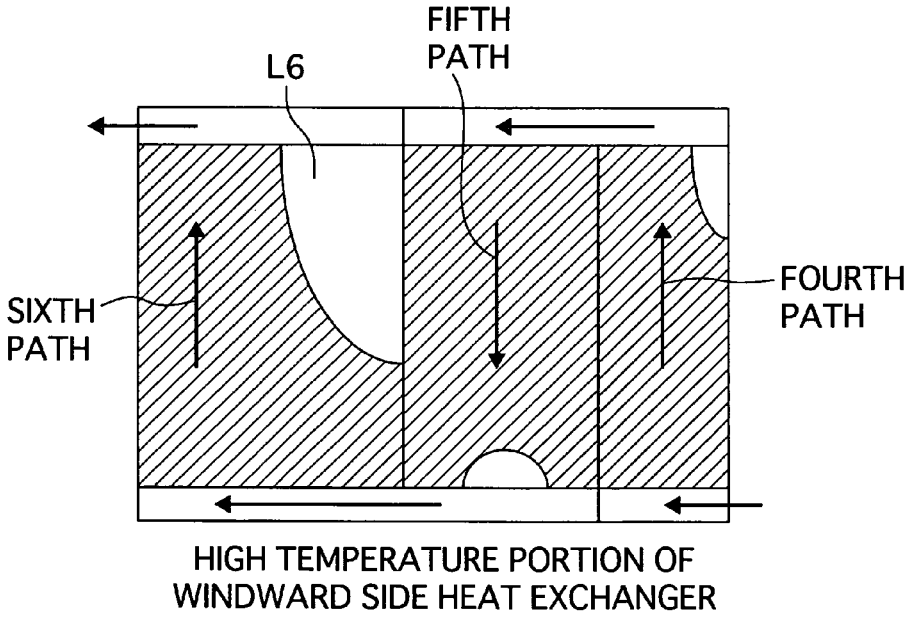
FIG. 8B is a schematic view illustrating the section setting of each path in an exit-side heat exchanger in the conventional evaporator.

Moreover, in JP 2006-242406A, an evaporator in which the number of heat exchange passages in the first path is reduced to be smaller than the number of heat exchange passages in any other paths in the entry-side heat exchanger, and the number of heat exchange passages is gradually increased from the fourth path to the final path (six path) in the exit-side heat exchanger is proposed, in order to further reduce the unevenness of temperature distribution. However, in the exit-side heat exchanger of the windward side having one path of downward flow and two paths of upward flow, as illustrated in FIG. 8B, the number of heat exchange passages in the sixth path in which the refrigerant flows upward is set larger than that in the fourth path and the fifth path. For this reason, in the exit-side heat exchanger of the windward side, as illustrated in FIG. 8B, a region L6 in which the refrigerant flow volume is reduced is generated in the front side of the longitudinal direction of the tank in the sixth path of the exit-side heat exchanger of the windward side is generated, and a high temperature portion is locally generated in the area L6 in which the refrigerant flow volume is reduced in the region L6.

It is, therefore, the focus of the present invention focus to minimize the regions L1, L6 in which the refrigerant flow volume is reduced in the first path 10*a* of the entry-side heat exchanger 10 and the sixth path 20*c* of the exit-side heat exchanger 20, so as to make uniform the temperature distribution in the entire heat exchanger.

Accordingly, the sectional area of the heat exchange passage of the first path 10*a*, in which the refrigerant from the entry 7 firstly flows downward is set smaller than the sectional area of the heat exchange passage of the fifth path 20*b*, in which the refrigerant to the exit 8 lastly flows downward. Also, the sectional area of the heat exchange passage of the sixth path 20*c*, in which the refrigerant to the exit 8 finally flows upward, is set smaller than the sectional area of the heat exchange passage of the second path 10*b*, in which the refrigerant from the entry 7 firstly flows upward.

The reason that the regions L1, L6 in which the refrigerant flow volume is reduced in the first path 10*a* of the entry-side heat exchanger 10 and the sixth path 20*c* of the exit-side heat exchanger 20 by adopting the above structure will be described.

When the downward flow of refrigerant is compared to the upward flow of refrigerant, the flow velocity of the downward flow of the refrigerant, which flows down according to gravity, is increased, and the flow velocity of the upward flow, which flows up against gravity, is reduced. In addition, the first path 10*a* which is the start area of heat exchange has a liquid refrigerant ratio higher than that of the gas refrigerant. The gas refrigerant ratio is gradually increased compared to the liquid refrigerant from the second path 10*b* to the sixth path 20*c* in which the heat exchange is developed.

Considering refrigerant drift, if the sectional area of the flow path of the first path is set to be the same as the sectional area of the flow path of the fifth path in the downward flow in which the flow velocity of refrigerant is fast, refrigerant drift occurs in the first path, which has a high liquid refrigerant ratio, and does not require the sectional area of the flow path to be easier than the fifth path, which has a high gas refrigerant ratio.

If the sectional area of the flow path of the second path is set to be the same as the sectional area of the flow path of the sixth path in the upward flow in which the flow velocity of refrigerant is slow, refrigerant drift occurs in the sixth path having a high gas refrigerant ratio more easily than the second path having a high liquid refrigerant ratio.

On the other hand, in the evaporator 1 according to Embodiment 1, the relationship between the sectional area of the flow path of the first path 10*a* and the sectional area of the flow path of the fifth path 20*b* is set to the sectional area of the flow path of the first path< the sectional area of the flow path of the fifth path. Therefore, as is apparent from the comparison between FIG. 7 and FIG. 8A, the region L1 in which the refrigerant flow volume is reduced is eliminated, and the generation of the refrigerant drift in the first path 10*a* can be controlled even if the flow volume of refrigerant to be introduced is small, for example. The relationship between the sectional area of the flow path of the sixth path 20*c* and the sectional area of the flow path of the second path 10*b* is set so that the sectional area of flow path of the sixth path< the sectional area of the flow path of the second path, so that, as is apparent from the comparison between FIG. 7 and FIG. 8B, the region L6 in which the refrigerant flow volume is reduced is significantly reduced to the region L6', and the generation of refrigerant drift in the sixth path 20*c* in accordance with the gasification of the refrigerant is controlled.

Next, considering the refrigerant drift in more detail, in the downward flow of the first path, the third path and the fifth path in which the refrigerant flows down by its own weight, the ratio of liquid/gas refrigerant is the ultimate factor which determines the sectional area of the flow path. It is preferable to minimize the sectional area of the flow path of the first path having a high liquid refrigerant ratio and to increase according to the increase in the gas refrigerant ratio the sectional area of the flow path of the third path and the fifth path having a high gas refrigerant ratio.

In the upward flow of the second path, the fourth path and the sixth path in which the refrigerant is pushed up by the following refrigerant, the push-up energy by the liquid/gas refrigerant of the previous path (the first path, the third path and the fifth path) is also the ultimate factor which determines the sectional area of the flow path. It is preferable to maximize the sectional area of the flow path of the second path next to the first path having a high liquid refrigerant ratio and the highest push-up energy of refrigerant. It is also preferable for the sectional areas of flow paths of the sixth path next to the fifth path and the fourth path next to the third path to be smaller than the sectional area of the flow path of the second path because the fifth path and the third path have low push-up energy of refrigerant due to a high gas refrigerant ratio although the sectional area of the flow path is large.

On the other hand, in the evaporator 1 of Embodiment 1, regarding the relationships between the number of heat exchange passages in the first path 10*a* to the sixth path 20*c*, the following (1) to (4) are established.

(1) The number of passages in the first path 10*a*<the number of passages in the second path 10*b* to the number of passages in the sixth path 20*c*

(2) The number of passages in the second path 10*b*≧the number of passages in the third path 10*c*

(3) The number of passages in the third path 10*c*>the number of passages in the fourth path 20*a*

(4) The number of passages in the fifth path 20*b*>the number of passages in the sixth path 20*c*≧the number of passages in the fourth path 20*a*

Namely, in the downward flow of the first path 10*a*, the third path 10*c* and the fifth path 20*b*, the relationship among the sectional areas of the flow paths is set to the sectional area of the flow path of the first path<the sectional area of the flow path of the third path<the sectional area of the flow path of the fifth path in accordance with the increase in the sectional area of the flow path according to the increase in the gas refrigerant ratio. Therefore, as illustrated in FIG. 7, the region in which the refrigerant flow volume in the first path 10*a* is reduced is eliminated, and the regions L3', L5 in which the refrigerant flow volume in the third path 10*c* and the fifth path 20*b* is reduced are only seen in the region along the lower tanks 12, 12.

Meanwhile, in the upward flow of the second path 10*b*, the fourth path 20*a* and the sixth path 20*c*, the relationship among the sectional areas of the flow paths is set to the sectional area of the flow path of the second path>the sectional area of the flow path of the fourth path≧ the sectional area of the flow path of the fifth path in accordance with the size of the push-up energy of refrigerant in the paths 10*a*, 10*c*, 20*b* before the paths 10*b*, 20*a*, 20*c*, respectively. Therefore, as illustrated in FIG. 7, the region in which the refrigerant flow volume in the second path 10*b* is reduced is eliminated, the region L4' in which the refrigerant flow volume in the fourth path 20*a* is reduced is seen only in a part of the upper tank 21, and the region L6' in which the refrigerant flow volume in the sixth path 20*c* is reduced is seen only in a part of the upper tank 21.

The evaporator according to the present invention has a significant effect which reduces the unevenness of temperature distribution especially when the flow volume of circulating refrigerant is low. For example, when a compressor is driven by a vehicle engine, the refrigerant flow volume from the compressor can not be increased because of the limit of the driving force of the compressor, so that the refrigerant volume which constantly circulates in a refrigeration cycle is lowered. Accordingly, the evaporator of the present invention is especially suitable if it is connected to such a refrigeration cycle.

Next, effects will be described. In the evaporator according to Embodiment 1, the following effects can be obtained.

(1) The evaporator according to Embodiment 1 of the present invention comprises the heat exchanger including a plurality of heat exchange passages 31 each of which extends in the up-and-down direction and is laminated in the right-and-left direction, and the tanks 11, 12, 21, 22 which are connected to both ends of the heat exchange passages 31 and mix and distribute the refrigerant from the heat exchange passages 31. The heat exchanger has the two-layer structure having the entry-side heat exchanger 10 on the leeward side and the exit-side heat exchanger 20 on the windward side relative to the ventilating direction, and the entry 7 and the exit 8 of the refrigerant are provided at one of the right-and-left direction of the heat exchangers 10, 20. The communication portion 9 which connects the heat exchangers 10, 20 in communication with each other is provided in the other of the right-and-left direction of the heat exchangers 10, 20. After the refrigerant flows in the entry-side heat exchanger 10 from the entry 7, the refrigerant is led to the exit 7 via the exit-side heat exchanger 20. The entry-side heat exchanger 10 includes the first path 10*a* in which the refrigerant flows downward, the second path 10*b* in which the refrigerant flows upward, and the third path 10*c* in which the refrigerant flows downward. The exit-side heat exchanger 20 includes the fourth path 20*a* in which the refrigerant flows upward, the fifth path 20*b* in which the refrigerant flows downward, and the sixth path 20*c* in which the refrigerant flows upward. The sectional area of the heat exchange passages of the first path 10*a*, in which the refrigerant from the entry 7 firstly flows downward, is set smaller than the sectional area of the heat exchange passages of the fifth path 20*b*, in which the refrigerant to the exit 8 lastly flows downward. The sectional area of the heat exchange passages of the sixth path 20*c* in which the refrigerant to the exit lastly flows upward, is set smaller than the sectional area of the heat exchange passages of the second path 10*b*, in which the refrigerant from the entry 7 firstly flows upward. Therefore, by minimizing the regions L1, L6 in which the refrigerant flow volume is reduced, causing unevenness of temperature distribution, the temperature distribution in the heat exchanger can be equalized.

(2) Where the sectional area of each heat exchange passage in the first path 10*a*, the second path 10*b*, the third path 10*c*, the fourth path 20*a*, the fifth path 20*b* and the sixth path 20*c* is the same, regarding the relationships between the number of heat exchange passages in the first path 10*a* to the sixth path 20*c*, the following (a) to (d) are established, (a) The number of passages in the first path<the number of passages in the second path to the number of passages in the sixth path, (b) The number of passages in the second path≧the number of passages in the third path, (c) The number of passages in the third path>the number of passages in the fourth path, and (d) The number of passages in the fifth path>the number of passages in the sixth path≧the number of passage in the fourth path.

Therefore, the manufacturing control is easy, and the region having a reduced refrigerant flow volume which causes unevenness of temperature distribution can be minimized in the entire region of the first path 10*a* to the sixth path 20*c* by setting the relationships between the sectional areas of flow paths in accordance with the increase in the sectional area of the flow path according to the increase in the gas refrigerant ratio in the downward flow, and setting the relationships between the sectional areas of flow paths in accordance with the size of the push-up energy of the refrigerant in the previous path in the upward flow.

Accordingly, in the evaporator of the present invention, the sectional area of heat exchange passages of the first path, in which the refrigerant from the entry firstly flows downward, is set to be smaller than the sectional area of the heat exchange passages of the fifth path in which the refrigerant to the exit lastly flows downward. The sectional area of heat exchange passages of the sixth path, in which the refrigerant to the exit lastly flows upward, is set smaller than the sectional area of heat exchange passages of the second path, in which the refrigerant from the entry firstly flows upward. More particularly, when the downward flow of the refrigerant is compared to the upward flow of the refrigerant, the flow velocity of the downward flow which flows down according to gravity is increased and the flow velocity of the upward flow which flows up against gravity is lowered. The first path which is the start region of heat exchange has a liquid refrigerant ratio higher than the gas refrigerant ratio, and the gas refrigerant ratio is gradually increased compared to the liquid refrigerant from the second path to the six path in which the heat exchange is developed. Considering the refrigerant drift, if the sectional area of the first path is set to be the same as the sectional area of the fifth path in the downward flow where the refrigerant flow velocity is fast, refrigerant drift occurs in the first path which has a high liquid refrigerant ratio and does not require the sectional area of the flow path to be easier than in the fifth path having a high refrigerant ratio. If the sectional area of the second path is also set to be the same as the sectional area of the sixth path in the upward flow where the refrigerant flow speed is slow, refrigerant drift occurs in the sixth path having a high refrigerant ratio easier than the second path having a high liquid refrigerant ratio. The relationship between the sectional areas of the first path and the fifth path is set to the sectional area of the flow path of the first path<the sectional area of the flow path of the fifth path, so that the occurrence of refrigerant drift in the first path can be controlled even if the refrigerant flow volume to be introduced is small. The relationship between the sectional areas of the sixth path and the second path is set to the sectional area of the flow path of the sixth path<the sectional area of the flow path of the second path, so that the occurrence of the refrigerant drift in the sixth path according to the gasification of refrigerant can be controlled. As a result, by minimizing the region having a reduced refrigerant flow volume which causes unevenness of temperature distribution, the temperature distribution in the heat exchanger can be equalized.

As described above, although the evaporator of the present invention is described according to Embodiment 1, the specific structure is not limited to Embodiment 1, and it should be appreciated that variations, additions and the like may be made to the design without departing from the scope of the present invention as defined by the following claims.

In Embodiment 1, an example in which the relationships between the number of heat exchange passages of the first path 10*a* to the sixth path 20*c* are precisely set is described. However it is not limited to Embodiment 1 as long as the sectional area of the heat exchange passages of the first path in which the refrigerant from the entry 7 firstly flows downward is set smaller than the sectional area of the heat exchange passages of the fifth path in which the refrigerant to the exit 8 lastly flows downward, and the sectional area of the heat exchange passages of the sixth path 20*c* in which the refrigerant to the exit 8 lastly flows upward is set smaller than the sectional area of the heat exchange passages of the second path 10*b* in which the refrigerant from the entry 7 firstly flows upward.

The present application is based on and claims priority from Japanese Patent Application No. 2007-115257, filed on Apr. 25, 2007, the disclosure of which is hereby incorporated by reference in its entirety.

INDUSTRIAL FIELD OF THE INVENTION

In Embodiment 1, the evaporator of the present invention is applied to an evaporator of an automotive air conditioner. However, the use of the evaporator of the present invention is not limited thereto. The evaporator of the present invention can be applied as an evaporator of an air conditioner using a refrigeration cycle in another technical field.

The invention claimed is:

1. An evaporator comprising:

an entry-side heat exchanger including:

a plurality of entry-side heat exchange passages each extending in a vertical direction, said entry-side heat exchange passages being laminated along a horizontal direction;

an upper entry-side tank connected to an upper end of said entry-side heat exchange passages and configured to mix and guide a refrigerant flowing through said entry-side heat exchanger; and a lower entry-side tank connected to a lower end of said entry-side heat exchange passages and configured to mix and guide the refrigerant flowing through said entry-side heat exchanger; and an exit-side heat exchanger including:

a plurality of exit-side heat exchange passages each extending in a vertical direction, said exit-side heat exchange passages being laminated along a horizontal direction;

an upper exit-side tank connected to an upper end of said exit-side heat exchange passages and configured to mix and guide the refrigerant flowing through said exit-side heat exchanger; and a lower exit-side tank connected to a lower end of said exit-side heat exchange passages and configured to mix and guide the refrigerant flowing through said exit-side heat exchanger;

wherein said entry-side heat exchanger and said exit-side heat exchanger are joined to form a two-layer structure with said entry-side heat exchanger on a leeward side and said exit-side heat exchanger on a windward side relative to a ventilating direction, said two-layer structure having a first end and a second end opposite said first end;

wherein said upper entry-side tank has an inlet port at said first end of said two-layer structure for receiving a supply of the refrigerant, and said upper exit-side tank has an outlet port at said first end of said two-layer structure for discharging the refrigerant, said lower entry-side tank and said lower exit-side tank sharing a communication portion at said second end of said two-layer structure, said communication portion being configured to connect said entry-side heat exchanger to said exit-side heat exchanger so that, after the refrigerant flows through said entry-side heat exchanger from said inlet port, the refrigerant is guided to said exit-side heat exchanger via said communication portion and flows through said exit-side heat exchanger to said outlet port;

wherein said entry-side heat exchanger is configured so that said plurality of entry-side heat exchange passages is divided into a first path for guiding the refrigerant from said inlet port in a vertical downward direction, a second path communicating with and downstream of said first path for guiding the refrigerant in a vertical upward direction, and a third path communicating with and downstream of said second path for guiding the refrigerant in a vertical downward direction to said communication portion;

wherein said exit-side heat exchanger is configured so that said plurality of exit-side heat exchanger passages is divided into a fourth path for guiding the refrigerant from said communication portion in a vertical upward direction, a fifth path communicating with and downstream of said fourth path for guiding the refrigerant in a vertical downward direction, and a sixth path communicating with and downstream of said fifth path for guiding the refrigerant in a vertical upward direction to said outlet port;

wherein a combined sectional area of all of said entry-side heat exchange passages of said first path is smaller than a combined sectional area of all of said exit-side heat exchange passages of said fifth path; and wherein a combined sectional area of all of said exit-side heat exchange passages of said sixth path is smaller than a combined sectional area of all of said entry-side heat exchange passages of said second path.

2. The evaporator of claim 1, wherein a sectional area of each of said entry-side heat exchange passages in said first path, said second path, and said third path, and a sectional area of each of said exit-side heat exchange passages in said fourth path, said fifth path, and said sixth path is equal; and wherein relationships between a quantity of said entry-side heat exchange passages in said first path, said second path, and said third path, and a quantity of said exit-side heat exchange passages in said fourth path, said fifth path, and said sixth path are as follows:

(a) the quantity of said entry-side heat exchange passages in said first path<the quantity of said entry-side heat exchange passages in said second path to the quantity of said exit-side heat exchange passages in said sixth path;

(b) the quantity of said entry-side heat exchange passages in said second path≧the quantity of said entry-side heat exchange passages in said third path;

(c) the quantity of said entry-side heat exchange passages in said third path>the quantity of said exit-side heat exchange passages in said fourth path; and (d) the quantity of said exit-side heat exchange passages in said fifth path>the quantity of said exit-side heat exchange passages in said sixth path≧the quantity of said exit-side heat exchange passages in said fourth path.

* * * * *